United States Patent [19]

Chermak

[11] Patent Number: 4,472,843

[45] Date of Patent: Sep. 25, 1984

[54] BATHTUB ACCESSORY HOLDER

[76] Inventor: Linda Chermak, 72 Hayloft Ct., Huntington Station, N.Y. 11746

[21] Appl. No.: 491,753

[22] Filed: May 5, 1983

[51] Int. Cl.[3] ..... A47K 3/00

[52] U.S. Cl. ..... 4/559; 4/548; D6/86; 312/233; 108/13; 211/42

[58] Field of Search ..... 4/546, 548, 559, 574; D6/86, 91; 248/460; 312/232, 233, 282; 108/6, 13, 32; 211/42, 43

[56] References Cited

U.S. PATENT DOCUMENTS

| | | | |
|---|---|---|---|
| 236,588 | 1/1881 | Hoffmeier | 312/233 X |
| 910,041 | 1/1909 | Campbell | 312/232 |
| 1,916,667 | 7/1933 | Hoogendyk | 248/441 |
| 2,150,483 | 3/1939 | Bentz | 4/574 |
| 2,628,147 | 2/1953 | Berner | 108/146 X |
| 3,239,850 | 3/1966 | Kiss | 4/559 |

FOREIGN PATENT DOCUMENTS

| | | | |
|---|---|---|---|
| 180 | 3/1954 | Philippines | 248/460 |

OTHER PUBLICATIONS

Modern Plastics, Dec., 1947, p. 98, "Bathtub Dressing Table".

*Primary Examiner*—Charles E. Phillips
*Attorney, Agent, or Firm*—Michael I. Kroll

[57] ABSTRACT

A bathtub accessory holder is provided and consists of a platform having a support member with a fog proof mirror on one side and a pair of pivotally connected arms so that the support member can be positioned on the platform in such manner to create a writing tablet, a book support or a make up mirror. The bathtub accessory holder also contains a first container to hold cotton balls and the like, a second container to hold pencils and the like, a drinking container and a nail polish holder.

1 Claim, 4 Drawing Figures

BATHTUB ACCESSORY HOLDER

BACKGROUND OF THE INVENTION

1. Field of Invention

The instant invention relates generally to bathtub accessories and more specifically it relates to a bathtub accessory holder.

2. Description of the Prior Art

Numerous bathtub accessories have been provided in prior art that are adapted to be position between top edges of a bathtub. For example, U.S. Pat. Nos. 1,944,049 and 2,006,169 are illustrative of such prior art. While these units may be suitable for the particular purpose to which they address, they would not be as suitable for the purposes of the present invention as heretofore described.

SUMMARY OF THE INVENTION

The present invention is equipped with a platform, four rubber feet, a support member, a fog proof mirror, a pair of arms, a flap member, a first container, a second container, a drinking container and a nail polish holder. The support member can be positioned as a book support, a writing tablet or a make up mirror.

A principle object of the present invention is to provide a bathtub accessory holder that can support an opened book in an upright angular position.

Another object is to provide a bathtub accessory holder that can be used as a writing tablet or a make up mirror.

An additional object is to provide a bathtub accessory holder that can support a multiple of different containers to hold various substances when a person is in the bathtub.

A further object is to provide a bathtub accessory holder that is simple and easy to use.

A still further object is to provide a bathtub accessory holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DETAILED DESCRIPTION OF THE PREFERRED EMBODIMENTS

Figure 1:
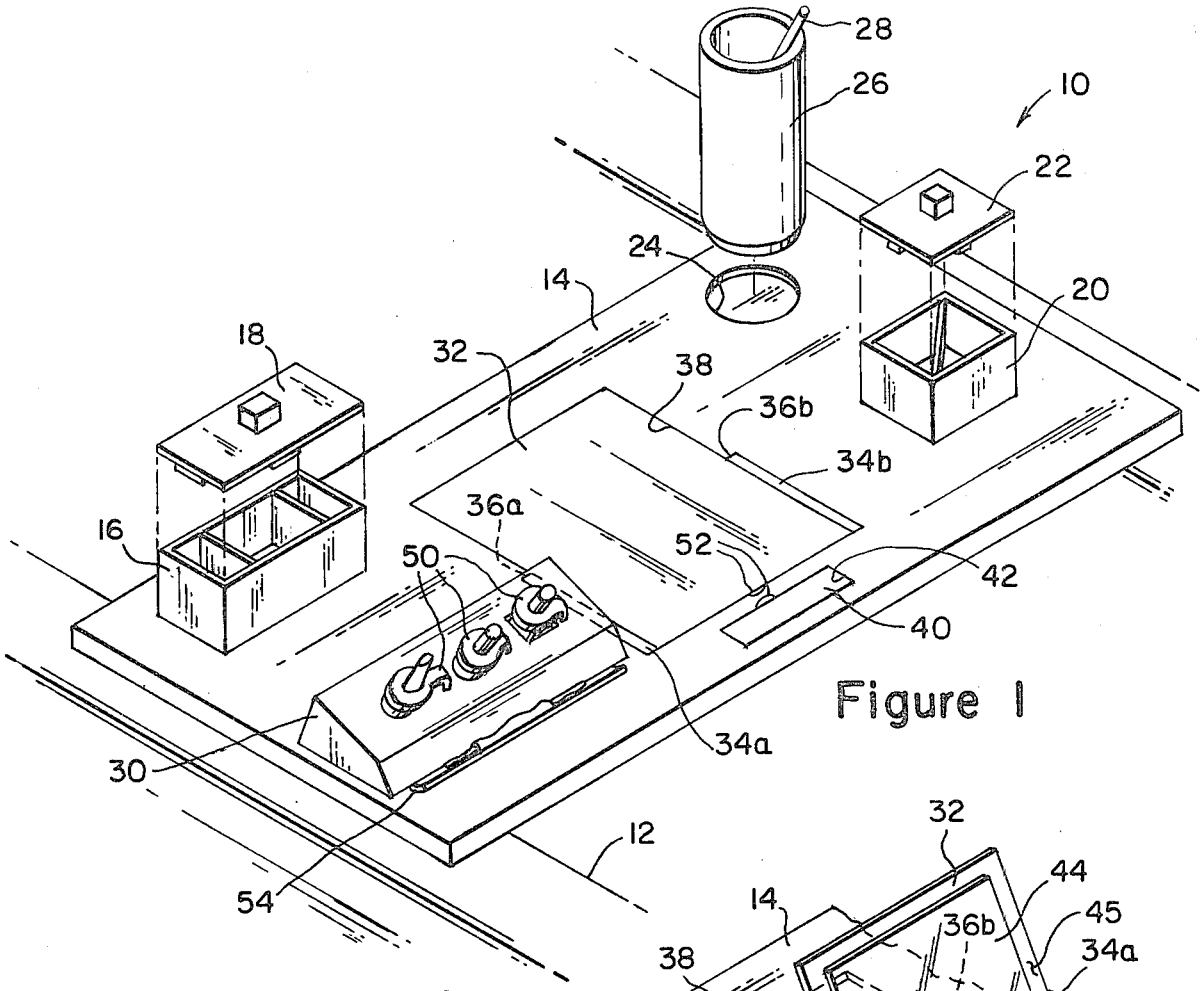
FIG. 1 is a perspective view of the invention with the support member as a writing tablet in position on top edges of a bathtub.

Turning now descriptively to the drawings, in which similar reference characters denote similar elements throughout the several views, FIGS. 1 through 4 illustrates a bathtub accessory holder 10 that consists of a platform 14, four rubber feet 48, a support member 32, a pair of arms 34*a* and 34*b*, a flap member 40, a fog proof mirror 44, a first container 16, a second container 20, a drinking container 26 and a nail polish holder 30.

The platform 14 has a square like recess 38 with opposite side stops 36*a* and 36*b* and a rectangular like recess 42 in front of the square like recess 38 in central portion of the platform 14 thereof.

Each foot 48 is affixed to bottom surface 46 at each corner of the platform 14 to engage top edges of the bathtub 12 to prevent the platform 14 from moving.

Figure 2:
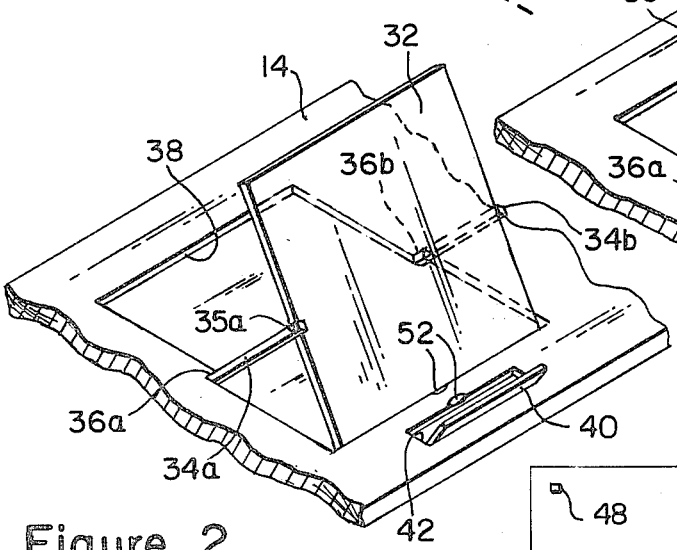
FIG. 2 is a partial perspective view with the support member as a book support.

As best shown in FIG. 2 each arm 34*a* and 34*b* is pivoted at one end 35*a* and 35*b* to middle side of the support member 32 while free end engages one side stop 36*a* and 36*b* of the square like recess 38 of the platform 14. Front edge of the support member 32 engages front edge of the square like recess 38 of the platform 14. The flap member 40 is pivotally affixed to front end of short side of the rectangular like recess 42 of said platform 14 so that the flap member 40 is in an up position to engage bottom of an opened book (not shown). The support member 32 will hold the book in an upright angular position thus providing a book support.

In FIG. 1 the support member 32 and the pair of arms 34*a* and 34*b* can lie flat within the square like recess 38 of the platform 14 while the flap member 40 can pivot in a down position to lie flat within the rectangular like recess 42 of the platform 14 so that the support member 32 can be used as a writing tablet.

Figure 3:
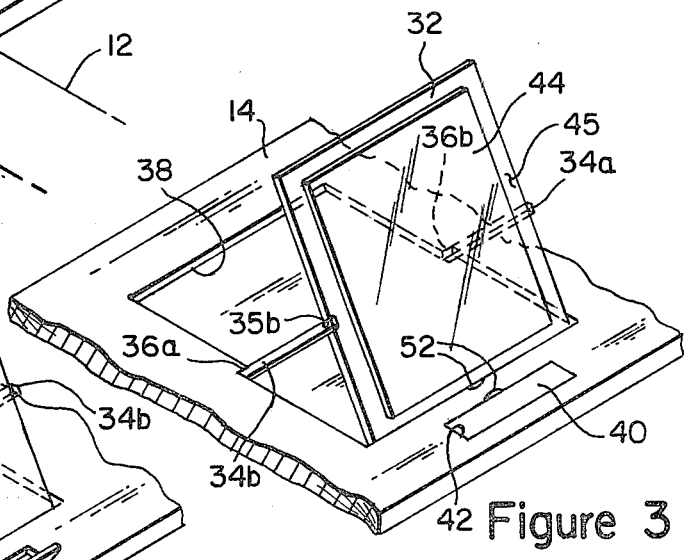
FIG. 3 is a partial perspective view with the support member as a make up mirror.
Figure 4:
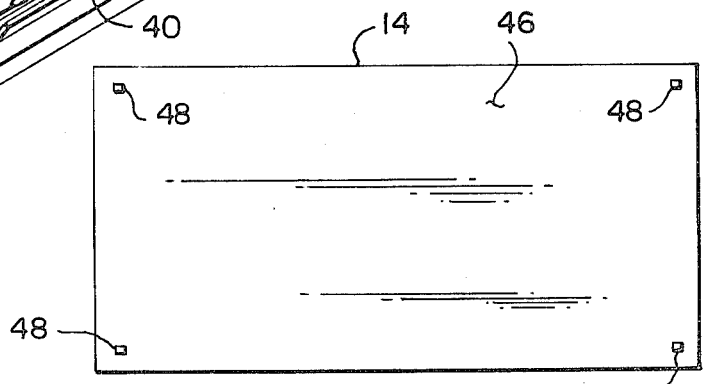
FIG. 4 is a bottom plan view of the platform.

In FIG. 3 the fog proof mirror 44 is affixed to bottom surface 45 of the support member 32 so that when the support member 32 is turned around and placed in an upright angular position the support member 32 can be used as a make up mirror.

As shown in FIG. 1 the first container 16 has a removable cover 18. The first container 16 is affixed to top surface near top left corner of the platform 14 and is adapted to hold cotton balls and the like. The second container 20 has a removable cover 22. The second container 20 is affixed to the top surface near bottom right corner of the platform 14 and is adapted to hold pencils and the like. The drinking container 26 has a straw 28. The drinking container 26 is removably placed within a circular recess 24 in the top surface near top right corner of the platform 14 and is adapted to hold liquid refreshments. The polish holder 30 has a plurality of bottle clamps 50 to hold nail polish and a lip 54 to hold a manicure tool. The nail polish holder 30 is affixed to the top surface near the bottom left corner of platform 14 and is angled so that the user need not tilt the bottle to use its contents.

A finger lift notch 52 can be placed on front edge of the square like recess 38 and rear edge of the rectangular like recess 42 so that the support member 32 and the flap member 40 can be easily lifted out of their respected recesses 38 and 42 when needed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A bathtub accessory holder which comprises:

a rectangular platform having a square like recess with opposite side stops and having a front edge and a rectangular like recess in front of the square like recess in the central portion of said platform;

four rubber feet, each of said feet affixed to the bottom surface at each corner of said rectangular plarform to engage the top edges of the bathtub to prevent said platform from moving;

a support member having a front edge, a back edge and two side edges;

a pair of arms, each of said arms pivoted at one end to the middle of each side edge of said support member; said support can be pivoted about said pair of arms to lie flat within the square like recess of said platform or to have the front or back edge engage the front edge of said recess with the free ends of said arms engaging said side stops;

a fog proof mirror affixed to bottom surface of said support member so that when said support member is pivoted around said arms and said back edge engaged with said front edge of said square like recess said mirror will assume an upright position to be used as a make-up mirror;

a flap member having a front edge pivotally affixed to the front end of the long side of the rectangular like recess of said platform so that when said flap member is in the up position and said support member is pivoted to have its front edge engaged with the front edge of said square like recess a book can be supported between said support member and said flap member, when said support member is pivoted to a down position to lie flat in its recess said support member can be used as a writing surface;

a first container having a removable cover, said first container affixed to the top surface near top left corner of said platform and adapted to hold cotton balls and the like;

a second container having a removable cover, said second container affixed to the top surface near the bottom right corner of said platform and adapted to hold pencils and the like;

a drinking container with a straw, said drinking container removably placed with a circular recess in the top surface near the top right corner of said platform adapted to hold liquid refreshments; and a nail polish holder having a plurality of bottle clamps to hold nail polish and a lip to hold a manicure tool, said nail polish holder affixed to the top surface and angled so that the user need not tilt the bottle in order to use its contents.

* * * * *